US005498845A

United States Patent [19]

Browning

[11] Patent Number: 5,498,845

[45] Date of Patent: Mar. 12, 1996

[54] LIGHT SWITCH EXTENSION

[76] Inventor: William E. Browning, 128 Timberridge Dr., Staten Island, N.Y. 10306

[21] Appl. No.: 353,493

[22] Filed: Dec. 8, 1994

[51] Int. Cl.[6] ..... H01H 3/20

[52] U.S. Cl. ..... 200/331; 200/330; 16/115

[58] Field of Search ..... 200/331, 330, 200/329, 332; 16/115, 114 R; 13/168, 169, 170, 173, 174

[56] References Cited

U.S. PATENT DOCUMENTS

| | | | |
|---|---|---|---|
| 4,590,345 | 5/1986 | Marshell | 200/331 |
| 4,899,050 | 2/1990 | Cranflone | 200/331 |
| 5,017,746 | 5/1991 | Guimarin | 200/331 |
| 5,380,967 | 1/1995 | Steen et al. | 200/331 |
| 5,393,946 | 2/1995 | DeLaHoz | 200/331 |

*Primary Examiner*—Henry J. Recla
*Assistant Examiner*—David J. Walczok

[57] ABSTRACT

An extension for facilitating operation of a light switch from a distance below the switch. The inventive device includes an elongated member having a handle at a first end thereof and an engaging assembly at a second thereof. The engaging assembly can be releasably coupled to the toggle member of the switch to facilitate operation of the switch by a child positioned below the switch.

2 Claims, 2 Drawing Sheets

LIGHT SWITCH EXTENSION

BACKGROUND OF THE INVENTION

1. Field of the Invention

The present invention relates to handling devices and more particularly pertains to a light switch extension for facilitating operation of a light switch from a distance below the switch.

2. Description of the Prior Art

The use of handling devices is known in the prior art. More specifically, handling devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art handling devices include U.S. Pat. Nos. 4,870,232; 4,590,345; 3,839,615; 5,055,645; Des. 252,552; Des. 274,972; Des. 314,496 and Des. 335,121.

While these devices fulfill their respective, particular objectives and requirements, the aforementioned patents do not disclose a light extension for facilitating operation of a light switch from a distance below the switch which includes an elongated member having a handle at a first end thereof and an engaging assembly at a second thereof for releasably coupling to a toggle member of the switch to facilitate operation of the switch by a child positioned therebelow. Furthermore, none of the known prior art handling devices teach or suggest a light switch extension of the aforementioned structure constructed of a glow-in-the-dark material which further includes at least one magnet attached to a back surface thereof for facilitating a releasable engagement of the light switch extension to the exterior screws of an associated light switch.

In these respects, the light switch extension according to the present invention substantially departs from the conventional concepts and designs of the prior art, and in so doing provides an apparatus primarily developed for the purpose of facilitating operation of a light switch from a distance below the switch.

SUMMARY OF THE INVENTION

In view of the foregoing disadvantages inherent in the known types of handling devices now present in the prior art, the present invention provides a new light switch extension construction wherein the same can be utilized for facilitating operation of a light switch from a distance below the switch. As such, the general purpose of the present invention, which will be described subsequently in greater detail, is to provide a new light switch extension apparatus and method which has many of the advantages of the handling devices mentioned heretofore and many novel features that result in a light switch extension which is not anticipated, rendered obvious, suggested, or even implied by any of the prior art handling devices, either alone or in any combination thereof.

To attain this, the present invention generally comprises an extension for facilitating operation of a light switch from a distance below the switch. The inventive device includes an elongated member having a handle at a first end thereof and an engaging assembly at a second thereof. The engaging assembly be releasably coupled to the toggle member of the switch to facilitate operation of the switch by a child positioned below the switch.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new light switch extension apparatus and method which has many of the advantages of the handling devices mentioned heretofore and many novel features that result in a light switch extension which is not anticipated, rendered obvious, suggested, or even implied by any of the prior art handling devices, either alone or in any combination thereof.

It is another object of the present invention to provide a new light switch extension which may be easily and efficiently manufactured and marketed.

It is a further object of the present invention to provide a new light switch extension which is of a durable and reliable construction.

An even further object of the present invention is to provide a new light switch extension which is susceptible of a low cost of manufacture with regard to both materials and labor, and which accordingly is then susceptible of low prices of sale to the consuming public, thereby making such light switch extensions economically available to the buying public.

Still yet another object of the present invention is to provide a new light switch extension which provides in the apparatuses and methods of the prior art some of the advantages thereof, while simultaneously overcoming some of the disadvantages normally associated therewith.

Still another object of the present invention is to provide a new light switch extension for facilitating operation of a light switch from a distance below the switch.

Yet another object of the present invention is to provide a new light switch extension which includes an elongated member having a handle at a first end thereof and an engaging assembly at a second thereof for releasably coupling to a toggle member of the switch to facilitate operation of the switch by a child positioned therebelow.

Even still another object of the present invention is to provide a new light switch extension constructed of a glow-in-the-dark material which further includes at least one magnet attached to a back surface thereof for facilitating a releasable engagement of the light switch extension to the exterior screws of an associated light switch.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
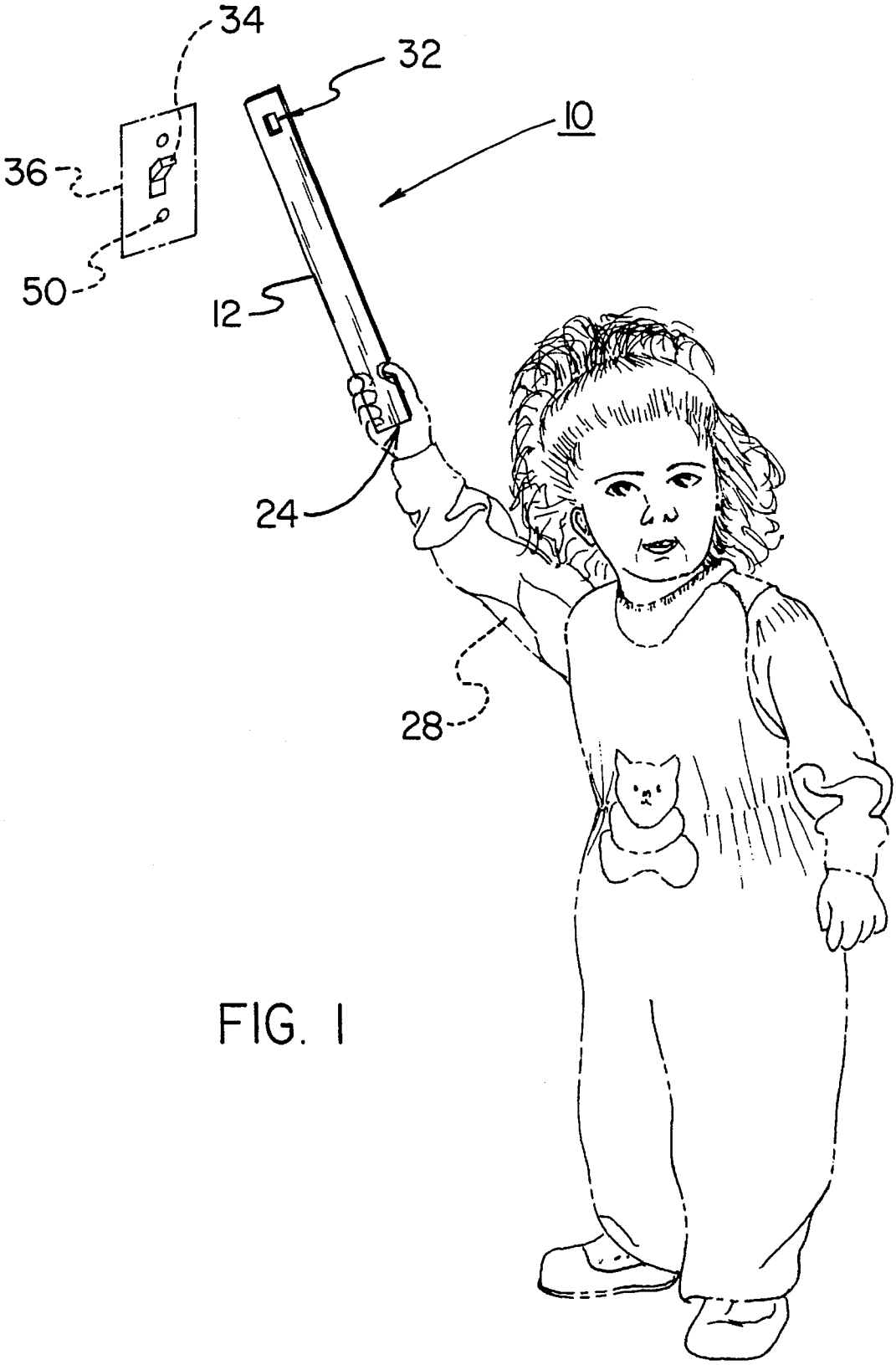
FIG. 1 is an isometric illustration of a light switch extension according to the present invention in use.
Figure 2:
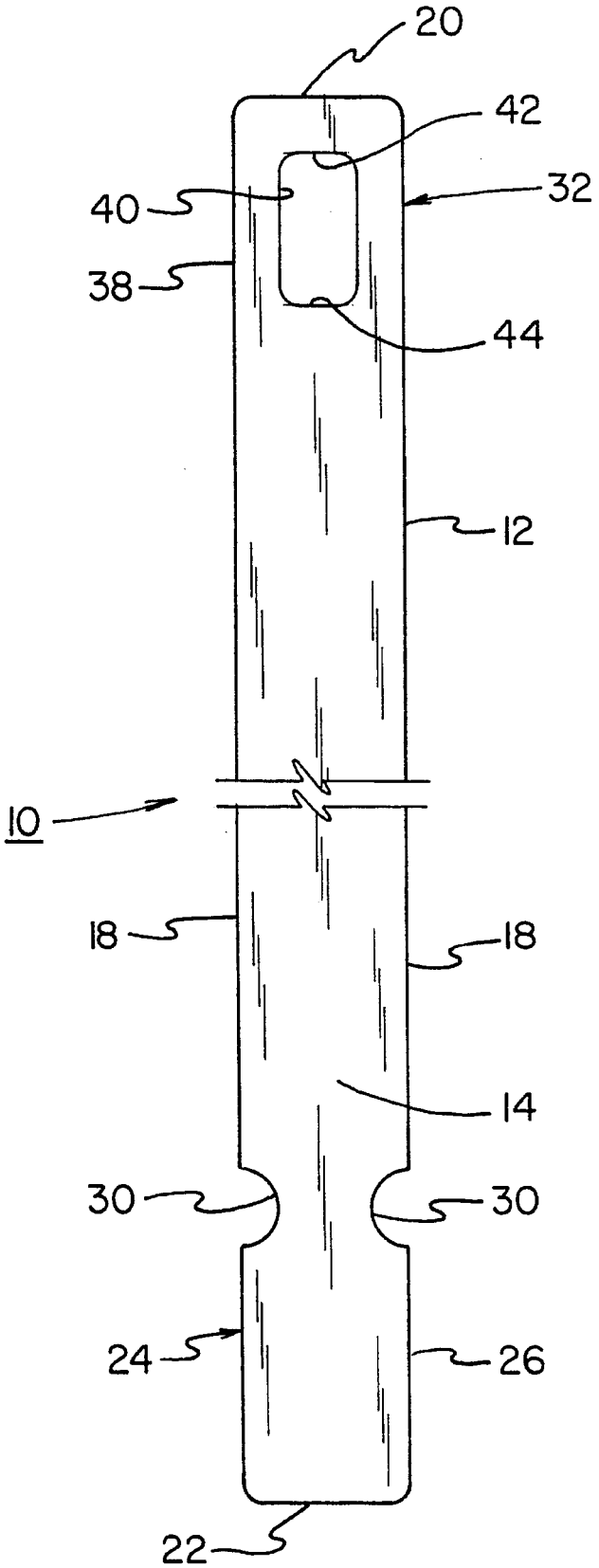
FIG. 2 is a front elevation view thereof.
Figure 3:
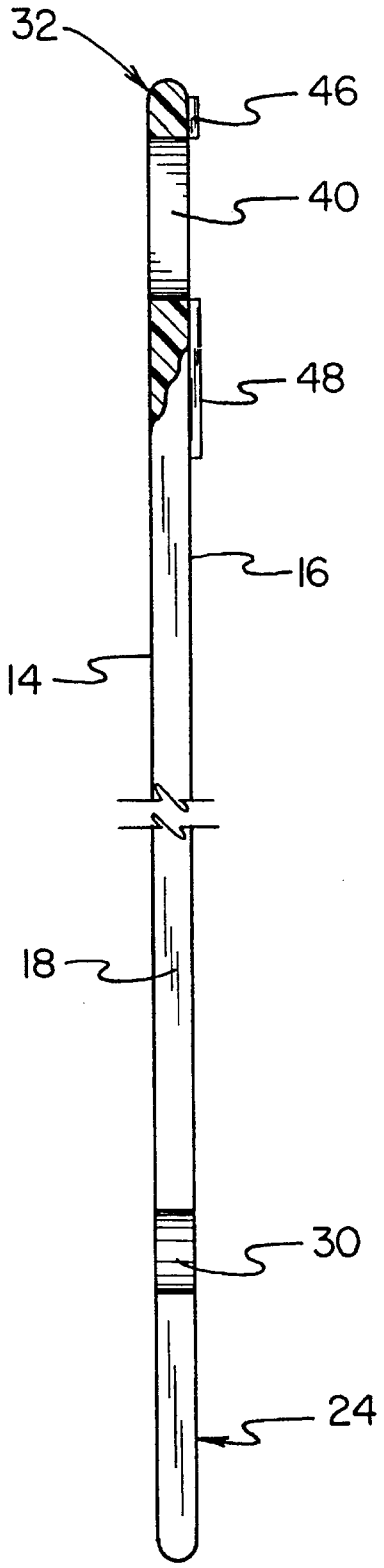
FIG. 3 is a side elevation view of the invention.

With reference now to the drawings, and in particular to FIGS. 1–3 thereof, a new light switch extension embodying the principles and concepts of the present invention and generally designated by the reference numeral 10 will be described.

More specifically, it will be noted that the light switch extension 10 comprises an elongated planar member having a front face 14 spaced from and parallel to a rear face 16, with opposed and parallel side walls 18 extending orthogonally between the front and rear faces. The elongated planar member 12 additionally includes a top wall 20 spaced from a bottom wall 22, with the top and bottom walls extending substantially orthogonally from both the front and rear faces 14, 16, as well as the opposed parallel side walls 18 to completely define the substantially elongated rectangular shape of the planar member 12.

A handle means 24 is defined at a lower end 26 of the elongated planar member 12 for permitting grasping and manipulating of the planar member by an individual, such as a child 28 as illustrated in FIG. 1. To this end, the handle means 24 of the present invention 10 preferably comprises a pair of semi-circular cut-outs 30 directed into the elongated planar member 12. In this respect, a first one of the semi-circular cut-outs 30 is directed into a first one of the opposed parallel side walls 18, with a second one of the semi-circular cut-outs 30 being directed into a second one of the opposed parallel side walls. By this structure, at least one digit of the child's hand can be securely mechanically engaged to the elongated planar member 12 during use and manipulation of the device 10.

As shown in FIGS. 2 and 3, an engaging means 32 for engaging and manipulating a toggle member 34 of a light switch 36 is defined at an upper end 38 of the elongated planar member 12. To this end, the engaging means 32 preferably comprises a rectangular aperture 40 directed through the elongated planar member 12 proximal to the upper end 38 thereof which extends from the front face 14 through the planar member to the rear face 16. By this structure, the substantially rectangular toggle member 34 of the light switch 36 can be received through the rectangular aperture 40, whereby upper and lower surfaces 42 and 44, respectively, can engage the toggle member 34 to bias the same in a desired direction. Thus, an individual positioned below the light switch 36, such as the child 28 illustrated in FIG. 1, can effect movement of the toggle member 34 to operate the light switch 36 by a positioning of the engagement means 32 over the toggle member and subsequently effecting a movement of the toggle member through a corresponding movement of the elongated planar member 12.

To removably retain the elongated planar member 12 relative to the light switch 26, a pair of magnetic plates can optionally be secured to the rear face 16 of the elongated planar member 12. To this end, the magnetic plates comprise a first magnetic plate 46 positioned between the top wall 20 and the rectangular aperture 40 and secured to the rear face 16 of the elongated planar member 12, and a second magnetic plate 48 positioned below the rectangular aperture 40 between the bottom wall 22 and the rectangular aperture and secured to the rear face 16 of the elongated planar member 12. The magnetic plates 46, 48 are operable to magnetically engage metallic exterior screws 50 of the light switch 36 to retain the device 10 relative thereto absent a manipulation of the device by the associated child 28.

In use, the light switch extension 10 can be easily utilized by a child 28 to effect operation of the toggle member 34 of an associated light switch 36. Further, the device 10 may also be utilized by handicapped persons or the like which can not reach a light switch 36, whereby operation of the light switch can be solely accomplished.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A light switch extension comprising:

an elongated planar member;

a handle means defined at a lower end of said elongated planar member for permitting grasping and manipulating of said planar member by an individual;

an engaging means defined at an upper end of said planar member for engaging and manipulating a toggle member of a light switch;

wherein said planar member includes a front face spaced from and parallel to a rear face, with opposed and parallel side walls extending orthogonally between said front and rear faces, said elongated planar member further including a top wall spaced from a bottom wall, with said top and bottom walls extending substantially orthogonally from both said front and rear faces and said opposed parallel side walls to define a substantially elongated rectangular shape of said planar member;

wherein said handle means comprises a pair of semi-circular cut-outs directed into said elongated planar member, with a first one of said semi-circular cut-outs being directed into a first one of said opposed parallel side walls, and a second one of said semi-circular cut-outs being directed into a second one of said opposed parallel side walls;

wherein said engaging means comprises a rectangular aperture directed through said elongated planar member proximal to said upper end thereof, said aperture extending from said front face through said planar member to said rear face thereof; and, a magnetic plate means for removably retaining said elongated planar member relative to said light switch.

2. The light switch extension of claim 1, wherein said magnetic plate means for removably retaining said elongated planar member relative to said light switch comprises a pair of magnetic plates secured to said planar member, said magnetic plates including a first magnetic plate positioned between said top wall and said rectangular aperture, and a second magnetic plate positioned between said rectangular aperture and said bottom wall, said magnetic plates being operable to magnetically engage metallic exterior screws of said light switch to retain said light switch extension relative to said light switch.

* * * * *